US008280080B2

(12) United States Patent
Philliber et al.

(10) Patent No.: US 8,280,080 B2
(45) Date of Patent: Oct. 2, 2012

(54) MICROCAP ACOUSTIC TRANSDUCER DEVICE

(75) Inventors: Joel Philliber, Fort Collins, CO (US); John Choy, Westminster, CO (US); David Martin, Fort Collins, CO (US)

(73) Assignee: Avago Technologies Wireless IP (Singapore) Pte. Ltd., Singapore (SG)

( * ) Notice: Subject to any disclaimer, the term of this patent is extended or adjusted under 35 U.S.C. 154(b) by 594 days.

(21) Appl. No.: 12/430,966

(22) Filed: Apr. 28, 2009

(65) Prior Publication Data

US 2010/0272310 A1 Oct. 28, 2010

(51) Int. Cl.

| | |
|---|---|
| ***H04R 25/00*** | (2006.01) |
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |
| ***H04R 1/02*** | (2006.01) |

(52) U.S. Cl. ..... 381/190; 381/171; 381/173; 381/175; 381/191; 381/355; 381/361; 381/369; 381/386; 381/388; 381/395

(58) Field of Classification Search ..... 381/171, 381/173, 175, 190, 191, 355, 361, 369, 386, 381/388, 395

See application file for complete search history.

(56) References Cited

U.S. PATENT DOCUMENTS

| | | | | |
|---|---|---|---|---|
| 3,609,416 | A * | 9/1971 | Epstein | 310/313 B |
| 4,779,246 | A * | 10/1988 | Dietzsch et al. | 367/157 |
| 4,860,368 | A * | 8/1989 | Payer et al. | 381/345 |
| 5,146,435 | A * | 9/1992 | Bernstein | 367/181 |
| 5,448,126 | A * | 9/1995 | Eda et al. | 310/313 A |
| 5,907,625 | A * | 5/1999 | Kanai et al. | 381/190 |
| 6,228,675 | B1 | 5/2001 | Ruby et al. | |
| 6,422,684 | B1 | 7/2002 | Ladabaum et al. | |
| 6,867,535 | B1 | 3/2005 | Ladabaum | |
| 6,900,509 | B2 | 5/2005 | Gallup et al. | |
| 6,969,942 | B2 * | 11/2005 | Takeshima et al. | 310/324 |
| 7,134,179 | B2 * | 11/2006 | Freeman et al. | 29/594 |
| 7,275,298 | B2 * | 10/2007 | Schindel | 29/594 |
| 7,277,555 | B2 * | 10/2007 | Klein et al. | 381/409 |
| 7,285,865 | B2 | 10/2007 | Kwon et al. | |
| 7,298,856 | B2 * | 11/2007 | Tajima et al. | 381/111 |
| 7,439,616 | B2 * | 10/2008 | Minervini | 257/704 |
| 7,466,834 | B2 * | 12/2008 | Ogura et al. | 381/174 |
| 7,569,906 | B2 * | 8/2009 | Mori et al. | 257/522 |
| 7,860,258 | B2 * | 12/2010 | Azuma et al. | 381/175 |

(Continued)

OTHER PUBLICATIONS

Zhuang et al. "Interconnection and Packaging for 2D Capacitive Micomachined Ultrasonic Transducer Arrays Basd on Through-Wafer Trench Isolation", Micro Electro Mechanical Systems, 2006. MEMS 2006 Istanbul. 19th IEEE International Conference 2006, pp. 270-273.

*Primary Examiner* — Ida M Soward

(57) ABSTRACT

A device includes a first wafer, a second wafer, a gasket bonding the first wafer to the second wafer to define a cavity between the first wafer and the second wafer, and an acoustic transducer disposed on the first wafer and disposed within the cavity between the first wafer and the second wafer. One or more apertures are provided for communicating an acoustic signal between the acoustic transducer and an exterior of the device. An aperture may be formed in the cavity itself, or the cavity may be hermetically sealed. An aperture may be formed completely through the first wafer and located directly beneath at least a portion of the acoustic transducer.

17 Claims, 10 Drawing Sheets

U.S. PATENT DOCUMENTS

| | | | | |
|---|---|---|---|---|
| 7,916,879 | B2 * | 3/2011 | Pedersen | 381/175 |
| 2003/0165252 | A1 * | 9/2003 | Pribyl | 381/369 |
| 2004/0201306 | A1 * | 10/2004 | Yamanouchi | 310/313 B |
| 2006/0141656 | A1 * | 6/2006 | Dehe et al. | 438/48 |
| 2006/0230835 | A1 * | 10/2006 | Wang | 73/718 |
| 2006/0238274 | A1 * | 10/2006 | Huang et al. | 333/193 |
| 2006/0285707 | A1 * | 12/2006 | Izuchi et al. | 381/191 |
| 2007/0165896 | A1 * | 7/2007 | Miles et al. | 381/356 |
| 2007/0291964 | A1 * | 12/2007 | Chien et al. | 381/174 |
| 2008/0123891 | A1 * | 5/2008 | Kato et al. | 381/361 |
| 2008/0144863 | A1 * | 6/2008 | Fazzio et al. | 381/190 |
| 2008/0203560 | A1 * | 8/2008 | Suzuki | 257/723 |
| 2008/0219482 | A1 * | 9/2008 | Sato | 381/174 |
| 2008/0252396 | A1 * | 10/2008 | Ruile et al. | 333/187 |
| 2008/0296717 | A1 * | 12/2008 | Beroz et al. | 257/434 |
| 2009/0016550 | A1 * | 1/2009 | Qiao | 381/175 |
| 2009/0257614 | A1 * | 10/2009 | Mei et al. | 381/355 |
| 2010/0195864 | A1 * | 8/2010 | Lutz et al. | 381/433 |
| 2010/0220889 | A1 * | 9/2010 | Adelman | 381/412 |
| 2010/0225006 | A1 * | 9/2010 | Haba et al. | 257/774 |
| 2011/0190617 | A1 * | 8/2011 | Chen | 600/407 |

* cited by examiner

MICROCAP ACOUSTIC TRANSDUCER DEVICE

BACKGROUND

Generally, acoustic transducers convert received electrical signals to acoustic signals when operating in a transmit mode, and/or convert received acoustic signals to electrical signals when operating in a receive mode. The functional relationship between the electrical and acoustic signals of an acoustic transducer depends, in part, on the acoustic transducer's operating parameters, such as natural or resonant frequency, acoustic receive sensitivity, acoustic transmit output power and the like.

Acoustic transducers are manufactured pursuant to specifications that provide specific criteria for the various operating parameters. Applications relying on acoustic transducers, such as piezoelectric ultrasonic transducers and electro-mechanical system (MEMS) transducers, for example, typically require precise conformance with these criteria. Furthermore, these operating parameters are subject to change due to contamination, humidity, temperature and other environmental factors.

In the past, some acoustic devices have been manufactured with processes where the acoustic transducer element is placed in a metal, ceramic, or plastic package and a lid is bonded to the package. With these techniques, a device has to be first cut or otherwise separated from the rest of the wafer before it could be packaged. However, this is relatively costly and results in a packaged part with a relatively large size.

Some newer semiconductor packaging techniques employ wafer-level packaging techniques wherein packaging is performed while the device remains with its wafer. In this fashion, hundreds or thousands of packaged devices can be created simultaneously, and then separated by sawing or other means.

However, these wafer-level packaging techniques can have problems when applied to acoustic transducer devices. The sawing process can generate contaminant particles. The device may also be exposed to moisture and high heat in known these wafer-level packaging techniques that can affect the reliability and operating parameters of the device.

U.S. Pat. No. 6,265,246 discloses a wafer-level package and packaging method that provide a hermetic seal without high voltages or high temperatures. However, in general, a hermetically sealed package is not well—suited to an acoustic transducer where it is desired to communicate an acoustic wave or signal between the acoustic transducer and the external environment.

SUMMARY

In a representative embodiment, a device comprises a first wafer, a second wafer, a gasket bonding the first wafer to the second wafer to define a cavity between the first wafer and the second wafer, and an acoustic transducer disposed on the first wafer and disposed within the cavity between the first wafer and the second wafer. The first wafer includes an aperture formed completely therethrough for communicating an acoustic signal between the acoustic transducer and an exterior of the device, said aperture being located directly beneath at least a portion of the acoustic transducer.

In another representative embodiment, a device comprises a first wafer, a second wafer, a gasket bonding the first wafer to the second wafer to define a cavity between the first wafer and the second wafer, and an acoustic transducer disposed on the first wafer and disposed within the cavity between the first wafer and the second wafer. The cavity includes an aperture for communicating an acoustic signal between the acoustic transducer and an exterior of the device

BRIEF DESCRIPTION OF THE DRAWINGS

The example embodiments are best understood from the following detailed description when read with the accompanying figures. It is emphasized that the various features are not necessarily drawn to scale. In fact, the dimensions may be arbitrarily increased or decreased for clarity of discussion. Wherever applicable and practical, like reference numerals refer to like elements.

DETAILED DESCRIPTION

In the following detailed description, for purposes of explanation and not limitation, representative embodiments disclosing specific details are set forth in order to provide a thorough understanding of an embodiment according to the present teachings. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the example embodiments. Such methods and apparatuses are clearly within the scope of the present teachings.

Furthermore, as used herein, the term "acoustic" encompasses sonic, ultrasonic, and infrasonic. For example, a transmitting acoustic transducer may transmit sonic, and/or ultrasonic, and/or infrasonic waves. Also, unless otherwise noted, when a first device is said to be connected to, or coupled to, a node, signal, or second device, this encompasses cases where one or more intervening or intermediate devices may be employed to connect or couple the first device to the node, signal, or second device. However, when a first device is said to be "directly connected" or "directly coupled" to a node, signal, or second device, then it is understood that the first device is connected or coupled to the node, signal, or second device without any intervening or intermediate devices interposed therebetween.

Moreover, when used herein the context of describing a value or range of values, the terms "about" and "approximately" will be understood to encompass variations of +/−10% with respect to the nominal value or range of values.

Figure 1:
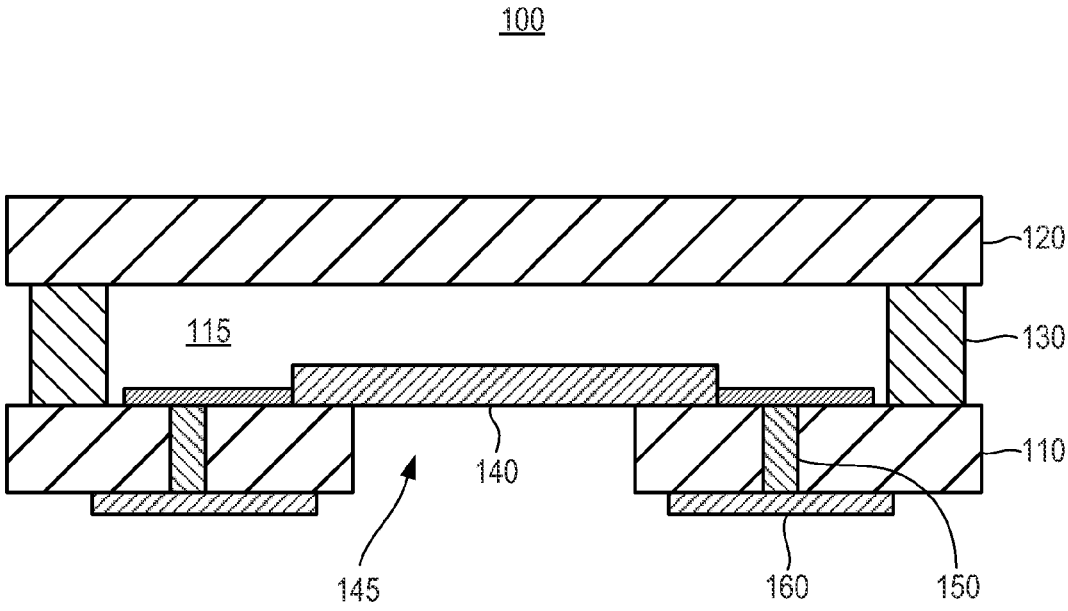
FIG. 1 illustrates a first example embodiment of a microcap acoustic transducer device.

FIG. 1 illustrates a first example embodiment of a microcap acoustic transducer device 100. Microcap acoustic transducer device 100 includes a first wafer 110, a second wafer 120, a gasket 130, and an acoustic transducer 140.

In one embodiment, first wafer 110 and/or second wafer 120 are semiconductor wafers, such as silicon or GaAs. In another embodiment, first wafer 110 and/or second wafer 120 are transparent substrates such as glass. Beneficially, however, first wafer 110 and second wafer 120 are made of the same material as each other to avoid thermal expansion mismatch problems.

Gasket 130 bonds first wafer 110 to second wafer 120 to define a cavity 115 between first wafer 110 and second wafer 120. Gasket 130 can be fabricated directly onto one of the bonded first and second wafers 110 and 120, or can be applied during the bonding process. Gasket 130 could be made of silicon, or some other material applied to one of the first and second wafers 110 and 120. A variety of materials could be used to bond the first and second wafers 110 and 120 together, including polymers (BCC, Polyimide, etc. . . . ) or different metals or metallic alloys (Au, Cu, Au—Hg alloy, etc.).

In one embodiment of microcap acoustic transducer device 100, gasket 130 hermetically seals cavity 115 between first wafer 110 and second wafer 120.

In another embodiment, gasket 130 may have a structure which permits air flow to pass between the exterior of microcap acoustic transducer device 100 and the cavity 115, which at the same time inhibiting or preventing contaminates from entering cavity 115 and coming in contact with acoustic transducer 140. An example of such a gasket 130 will be explained below with respect to FIG. 10.

Some materials and techniques for fabricating the gasket 130 and bonding the first and second wafers 110 and 120 with gasket 130 can be found in U.S. Pat. No. 6,265,246, the entirety of which is incorporated by reference herein for all purposes as if fully set forth herein.

In one embodiment, acoustic transducer 140 may be a thin film piezoelectric device. In that case, acoustic transducer 140 may include a stacked structure of a membrane, a bottom electrode, a piezoelectric film, and a top electrode. The membrane can be fabricated with any material compatible with semiconductor processes such as poly-silicon, Silicon Nitride, Silicon Carbide or Boron Silicate Glass. The bottom electrode can be made of a metal compatible with semiconductor processes such as Molybdenum, Tungsten or aluminum. The piezoelectric film can be of a material such as Aluminum Nitride. Lead Zirconate Titanate (PZT), or other film compatible with semiconductor processes. The top electrode can be made of a metal compatible with semiconductor processes such as Molybdenum, Tungsten or aluminum.

In another embodiment, acoustic transducer 140 may comprise a piezoelectric crystal.

In microcap acoustic transducer device 100, acoustic transducer 140 is disposed on first wafer 110 within cavity 115. Beneficially, first wafer 110 includes an aperture 145 formed completely therethrough for communicating an acoustic signal between acoustic transducer 140 and an exterior of microcap acoustic transducer device 100. Beneficially, aperture 145 is located directly beneath (or above, depending upon orientation of the device) at least a portion of acoustic transducer 140. Acoustic transducer 140 may operate in a transmit mode for transmitting an acoustic wave or signal, a receive mode for receiving an acoustic wave or signal, or a transmit/receive mode for operating in a transmit mode during some time periods, and in a receive mode in other time periods.

in some embodiments, microcap acoustic transducer device 100 may include more than one acoustic transducer 140 disposed within cavity 115. In that case, microcap acoustic transducer device 100 may include an acoustic transducer array.

Beneficially, in some embodiments of microcap acoustic transducer device 100, acoustic transducer 140 may communicate an acoustic signal to/from an exterior of microcap acoustic transducer device 100 while at the same time maintaining a hermetic seal in cavity 115.

Beneficially, cavity 115 is constructed to optimize the acoustic performance of acoustic transducer(s) 140. The depth and width of cavity 115 may be optimized to enhance the sensitivity of microcap acoustic transducer device 100; to amplify the output of acoustic transducer(s) 140 by constructively reflecting acoustic energy; to control the frequency; and/or suppress unwanted frequencies.

Also beneficially, first wafer 110 includes one or more vias 150 connecting acoustic transducer 140 and/or other electrical elements of microcap acoustic transducer device 100 with external pads or contacts 160.

In microcap acoustic transducer device 100, acoustic transducer 140 is disposed on first wafer 110. In some embodiments, first wafer 110 may also be referred to as a "base wafer," while second wafer 120 is a "cap wafer." In other embodiments, first wafer 110 may also be referred to as the "cap wafer," while second wafer 120 is the "base wafer." Acoustic transducer 140 may be disposed on either wafer.

Figure 2:
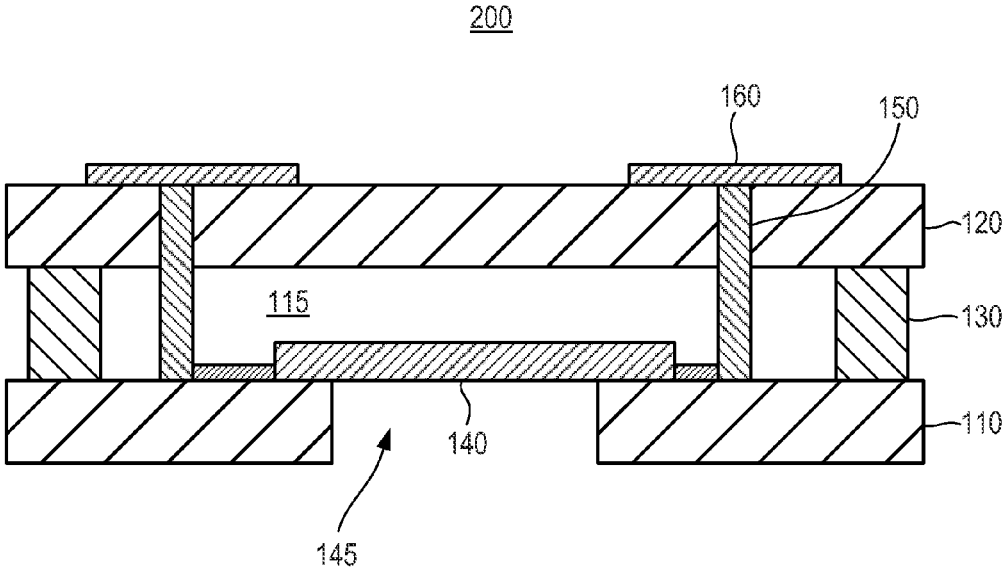
FIG. 2 illustrates a second example embodiment of a microcap acoustic transducer device.

FIG. 2 illustrates a second example embodiment of a microcap acoustic transducer device 200. Microcap acoustic transducer device 200 is similar to microcap acoustic transducer device 100, with a major difference being that external contact(s) 160 and associated via(s) 150 are provided on a different wafer than acoustic transducer 140.

Figure 3:
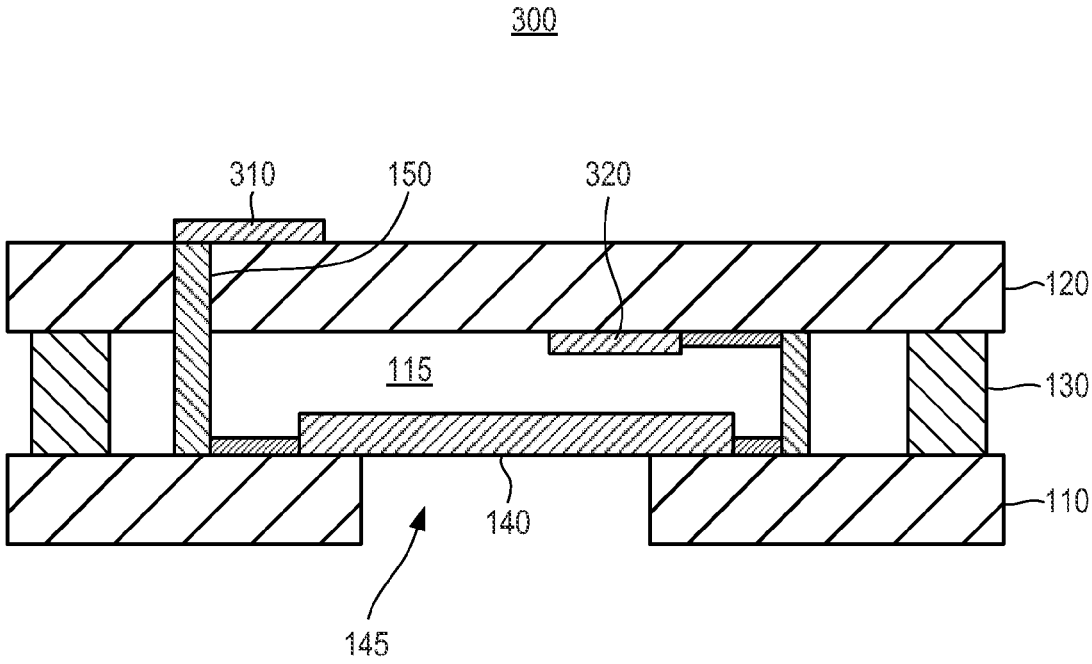
FIG. 3 illustrates a third example embodiment of a microcap acoustic transducer device.

FIG. 3 illustrates a third example embodiment of a microcap acoustic transducer device 300. Microcap acoustic transducer device 300 is similar to microcap acoustic transducer device 100, with a major difference being the presence of electrical circuits 310 and 320. Electrical circuit 310 is disposed at an exterior surface of second wafer 120, and is connected to acoustic transducer 1340 and/or other electrical circuit(s) in cavity 115 by means of via 150. Electrical circuit 320 is disposed at an interior surface of second wafer 120, inside cavity 115. Electrical circuits 310 and/or 320 may comprise a transducer driver (amplifier) for applying an electrical signal to acoustic transducer 140 to transmit an acoustic wave or signal or a signal receiver for receiving an electrical signal produced by acoustic transducer in response to a received acoustic wave or signal. Of course, in some embodiments only one of the electrical circuits 310 and 320 may be present.

Placing acoustic transducer 140 on one substrate and the electrical circuit(s) on the other substrate results in a much smaller footprint for microcap acoustic transducer device 300 compared to fabricating the transducer and electrical circuit's) separately and placing them next to each other on a printed circuit board.

Figure 4:
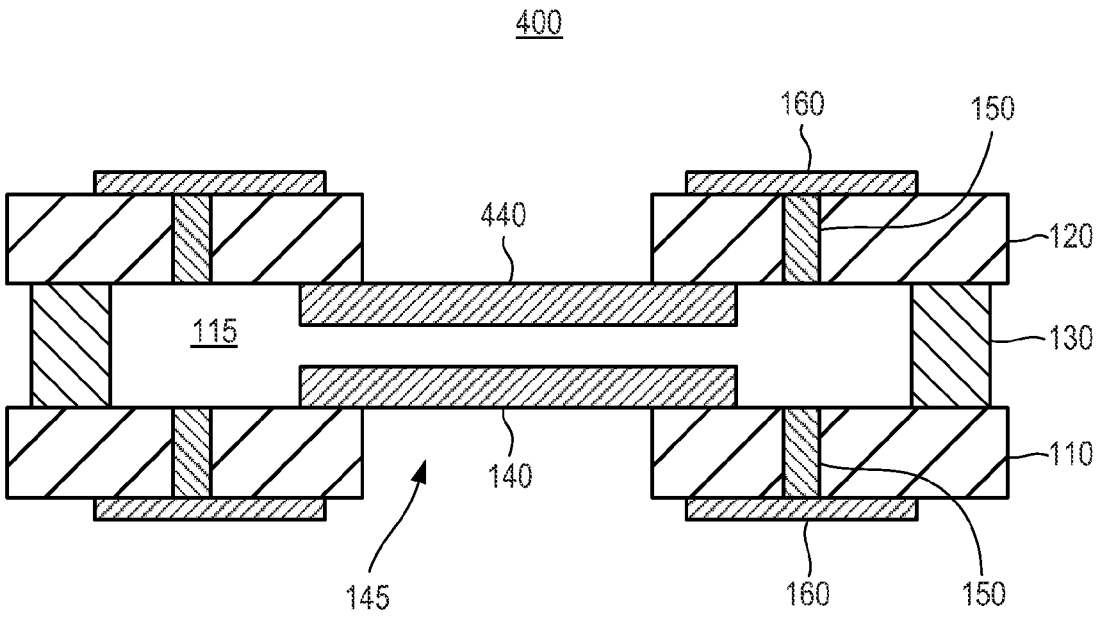
FIG. 4 illustrates a fourth example embodiment of a microcap acoustic transducer device.

FIG. 4 illustrates a fourth example embodiment of a microcap acoustic transducer device 400. Microcap acoustic transducer device 400 includes first acoustic transducer 140 and second acoustic transducer 440. Microcap acoustic transducer device 400 may include via(s) and external contact(s) 160 on either or both of first and second wafers 110 and 120.

By means of first and second acoustic transducers 140 and 440, acoustic energy can be transmitted (or received) simultaneously from both sides of microcap acoustic transducer device 400.

Figure 5:
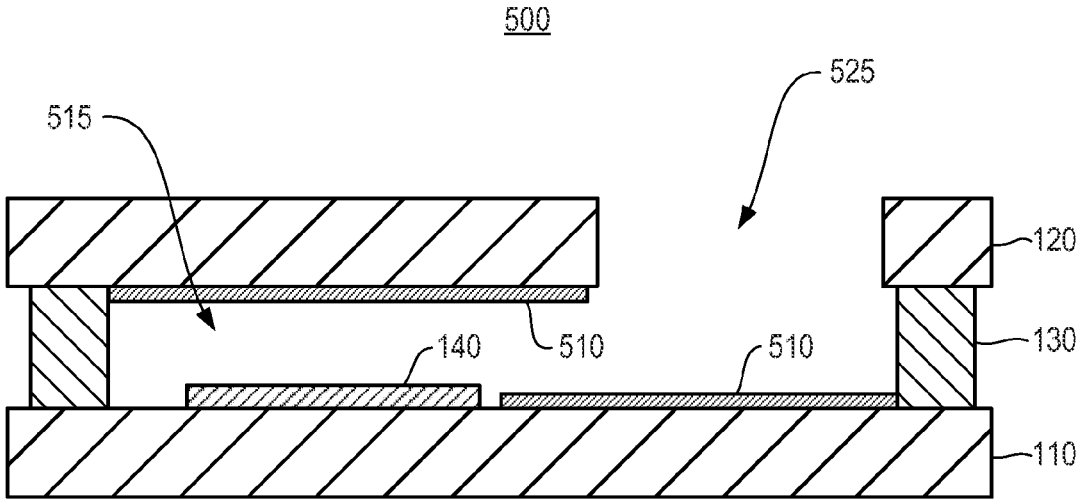
FIG. 5 illustrates a fifth example embodiment of a microcap acoustic transducer device.

FIG. 5 illustrates a fifth example embodiment of a microcap acoustic transducer device 500. In microcap acoustic transducer device 500, cavity 515 includes a cavity aperture 525 formed in second wafer 120. It should go without saying that cavity 515 is not hermetically sealed.

In contrast to microcap acoustic transducer device 100, in microcap acoustic transducer device 500 no aperture is provided in first wafer 110 beneath acoustic transducer 140. Nevertheless, acoustic transducer 140 may communicate an acoustic signal or wave with an exterior of microcap acoustic transducer device 500 by means of cavity aperture 525, and/or an aperture in gasket 130 as will be described in greater detail below with respect to FIG. 8. In another embodiment, a microcap acoustic transducer device may include both the cavity aperture 525 and aperture 145 beneath acoustic transducer 140. In that case, cavity aperture 525 may serve as an acoustic vent or port for microcap acoustic transducer device 500. An example of such an arrangement is illustrated in FIG. 6, which will be described below.

Although shown in FIG. 5 as being offset from acoustic transducer 140, in some arrangements cavity aperture 525 may be provided partially or completely above acoustic transducer 140.

Beneficially, microcap acoustic transducer device 500 includes an acoustic material 510 provided (e.g., as a coating) on one or more interior walls of cavity 515. Acoustic material 510 could be either reflective, or absorbing to acoustic energy, depending on the location of the material and the desired function.

Figure 6:
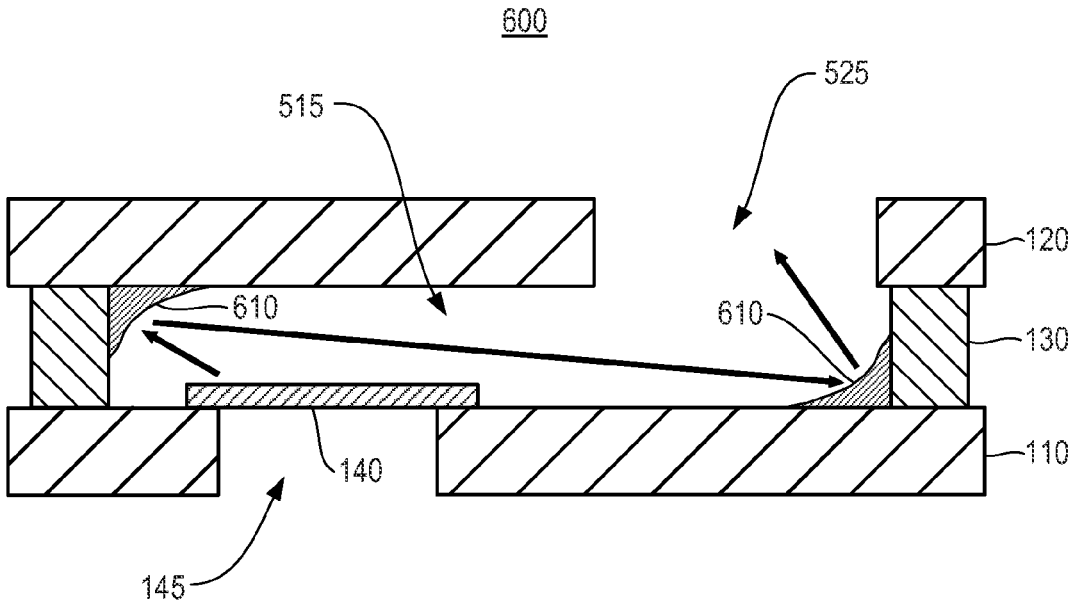
FIG. 6 illustrates a sixth example embodiment of a microcap acoustic transducer device.

FIG. 6 illustrates a sixth example embodiment of a microcap acoustic transducer device 600. Microcap acoustic transducer device 600 is similar to microcap acoustic transducer device 500, with the principle differences being the presence of aperture 145 in first wafer 110 beneath acoustic transducer 140, and the inclusion of acoustic reflectors 610 in lieu of could be built into the cavity to acoustic material 510 (in some embodiments, an acoustic transducer device may include both acoustic material 510 and acoustic reflector(s) 610).

Acoustic reflector(s) 610 direct acoustic energy from (or to) acoustic transducer 140 to (or from) cavity aperture 525 as shown in FIG. 6. In one embodiment, acoustic reflector(s) 610 are fabricated from a material that is efficient at reflecting acoustic energy. In another embodiment, acoustic reflector(s) 610 are coated with an acoustically reflective material.

Although the embodiments of FIGS. 5 & 6 show cavity aperture 525 being formed in second wafer 120, in alternative arrangements a similar aperture could be formed in first wafer 110 in place of, or in addition to, cavity aperture 525 in second wafer 120. Furthermore, as explained in greater detail below with respect to FIG. 10, an aperture can be formed in the gasket 130.

Figure 7:
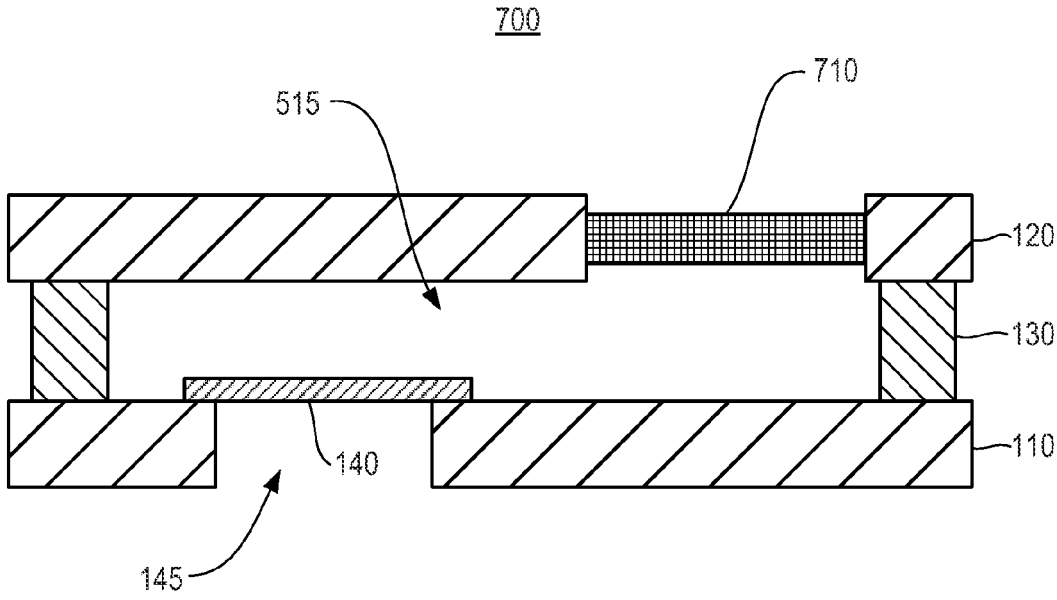
FIG. 7 illustrates a seventh example embodiment of a microcap acoustic transducer device.

FIG. 7 illustrates a seventh example embodiment of a microcap acoustic transducer device 700. Microcap acoustic transducer device 700 is similar to microcap acoustic transducer device 500, with the principle difference being the presence of a screen or mesh 710 covering cavity aperture 525 in second wafer 120. Beneficially, screen 710 includes a plurality additional apertures therethrough for communicating an acoustic signal between acoustic transducer 140 and the exterior of microcap acoustic transducer device 700. Beneficially, each of said apertures is substantially smaller (e.g., 10% or less) than the size of aperture 145 disposed beneath acoustic transducer 140.

Screen 710 may comprise a foam or solid acoustically transparent solid material to allow acoustic signals to enter or exit cavity 515, but limiting the amount of debris, contaminates and moisture that can enter cavity 515. In one embodiment, screen 710 is fabricated directly in second wafer 120. In another embodiment, screen 710 is applied after bonding first and second wafers 110 and 120.

Figure 8:
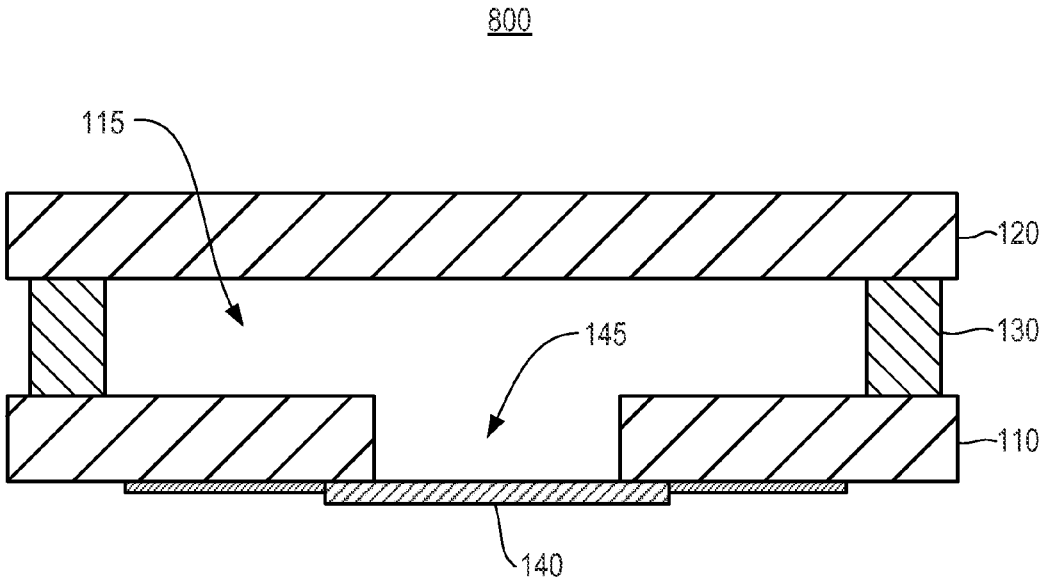
FIG. 8 illustrates an eighth example embodiment of a microcap acoustic transducer device.

FIG. 8 illustrates an eighth example embodiment of a microcap acoustic transducer device 800. Microcap acoustic transducer device 800 is similar to microcap acoustic transducer device 100, with the principle difference being that acoustic transducer 140 is provided on the opposite side of first wafer 110 in microcap acoustic transducer device 800 compared to microcap acoustic transducer device 100. Second wafer 120 can be used to tailor-make an acoustic cavity to amplify an acoustic signal generated by acoustic transducer 140, similar to making a loudspeaker cabinet. By locating acoustic transducer 140 outside cavity 15, it can also be possible to utilize a wider broadcast (or receive) signal. Furthermore, second wafer 120 can be employed to produce various electrical circuits, such as amplifiers or driver, signal receivers, etc.

Figure 9:
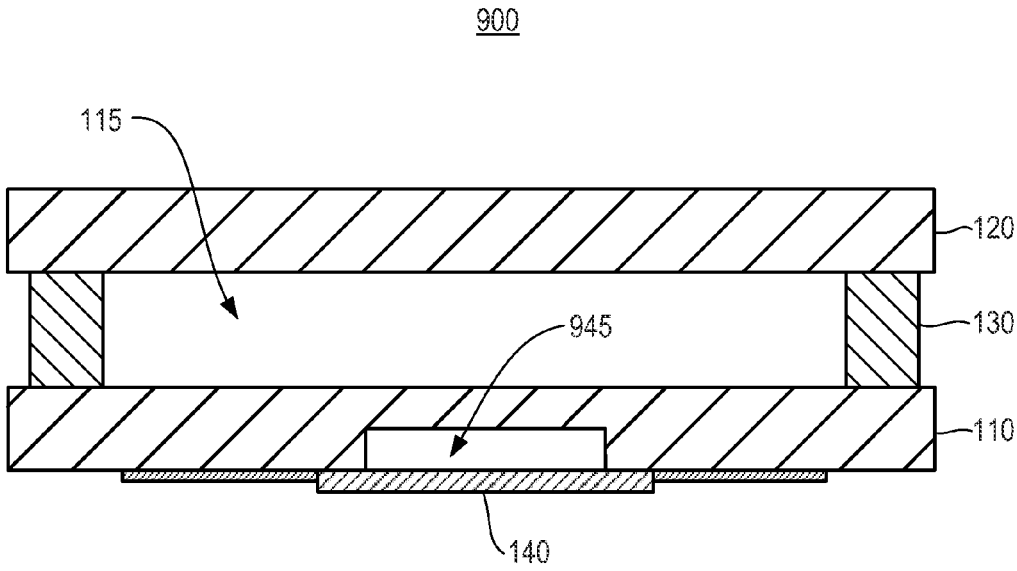
FIG. 9 illustrates a ninth example embodiment of a microcap acoustic transducer device.

FIG. 9 illustrates a ninth example embodiment of a microcap acoustic transducer device 900. Microcap acoustic transducer device 900 is similar to microcap acoustic transducer device 800, with the principle difference being that, instead of having aperture 145 formed completely through first wafer 110, a cavity 945 is formed partially extending through first wafer 110 directly beneath (or above, depending upon orientation of the device) at least a portion of acoustic transducer 140. By forming the cavity 945 only partially through first wafer 110, it is possible that the manufacturing process may be made easier and less costly, at the possible expense of reducing the sensitivity of the device.

Figure 10:
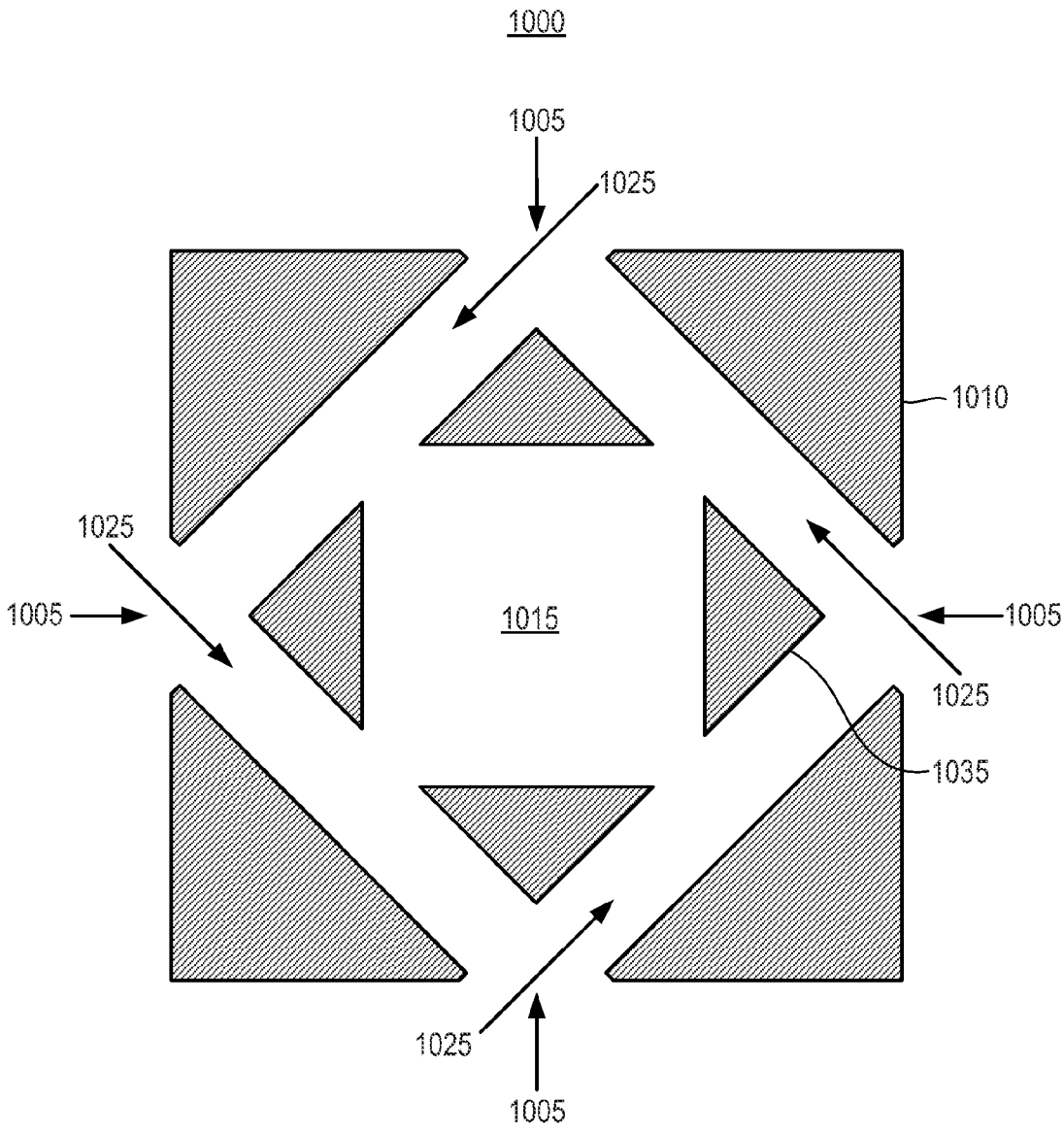
FIG. 10 illustrates a gasket that may be employed with one or more embodiments of a microcap acoustic transducer device.

FIG. 10 illustrates a gasket 1000 that may be employed with one or more embodiments of a microcap acoustic transducer device such as are shown in FIGS. 1-9. Gasket 1000 includes a plurality of openings 1005 where air and acoustic energy may be communicated between an interior area 1015 and an exterior of gasket 1000. Gasket 1000 also includes a plurality of channels 1025 which can direct any liquid, moisture, or contaminates which enter one opening 1005 toward another opening 1005 while inhibiting exposure to the interior area 1015 where, e.g., acoustic transducer(s) 140 may be disposed. In other words, blocking portion(s) 1035 in gasket 1000 are arranged in a way such that a cavity 115 or 515 in the acoustic transducer device is open, yet water or other fluids used in the assembly process (such as wafer sawing), would not have a direct path to electrical elements (e.g., acoustic transducer 140) in the interior of cavity 115 or 515. For example, in one embodiment blocking portion(s) 1035 are disposed in a straight line between opening(s) 1005 in gasket 1000 and the acoustic transducer 140. Other specific designs for the gasket of a microcap acoustic transducer device are possible, including gaskets that include no openings for embodiments where it is desired to hermetically seal the cavity 115.

While example embodiments are disclosed herein, one of ordinary skill in the art appreciates that many variations that are in accordance with the present teachings are, possible and remain within the scope of the appended claims. For example, it is understood that features shown individually FIGS. 1-7 could be combined in different ways to produce microcap acoustic transducer devices that include various combinations of these features. After a careful reading of the teachings of this specification and the drawings provided together herewith, such variations would be recognized by those of skill in the art. The embodiments therefore are not to be restricted except within the scope of the appended claims.

The invention claimed is:

1. A device, comprising:

a first wafer;

a second wafer;

a gasket bonding the first wafer to the second wafer to define a cavity between the first wafer and the second wafer, wherein the first and second wafers are semiconductor wafers; and a thin film acoustic transducer disposed on the first wafer and disposed within the cavity between the first wafer and the second wafer, wherein the first wafer includes an aperture formed completely therethrough for communicating an acoustic signal between the thin film acoustic transducer and an exterior of the device, said aperture being located directly beneath at least a portion of the thin film acoustic transducer.

2. The device of claim 1, wherein the gasket hermetically seals the cavity between the first wafer and the second wafer.

3. The device of claim 1, wherein the gasket includes at least one opening for communicating the acoustic signal between the acoustic transducer and the exterior of the device.

4. The device of claim 3, wherein the gasket further includes a blocking portion disposed in a straight line between the opening in the gasket and the acoustic transducer.

5. The device of claim 1, further comprising a second acoustic transducer disposed on the second wafer and disposed within the cavity between the first wafer and the second wafer, wherein the second wafer includes an aperture formed completely therethrough for communicating an acoustic signal between the second acoustic transducer and the exterior of the device, said aperture being located directly beneath at least a portion of the second acoustic transducer.

6. The device of claim 1, further comprising a via provided through one of the first and second wafers for making an electrical connection to the transducer or another element disposed within the cavity between the first wafer and the second wafer.

7. The device of claim 1, further comprising a transducer circuit element comprising at least one of a transducer driver and a signal receiver, wherein the transducer circuit element is disposed on the second wafer.

8. The device of claim 1, further comprising one or more additional acoustic transducers disposed on the first wafer and disposed within the cavity between the first wafer and the second wafer, wherein the first wafer includes a one or more additional apertures formed completely therethrough for communicating one or more additional acoustic signals between the one or more additional acoustic transducers and the exterior of the device, each said aperture being located directly beneath at least a portion of a corresponding one of the one or more additional acoustic transducers.

9. The device of claim 1, wherein at least a portion of an interior surface of the cavity is provided with an acoustically-reflecting material.

10. The device of claim 1, wherein at least a portion of an interior surface of the cavity is provided with an acoustically-absorbing material.

11. The device of claim 1, wherein at least one of the first and second wafers includes an additional aperture therethrough for communicating the acoustic signal between the acoustic transducer and the exterior of the device.

12. The device of claim 11, further comprising at least one acoustic reflector provided within the cavity for directing the acoustic signal between the acoustic transformer and the additional aperture.

13. The device of claim 1, wherein the cavity includes a plurality of additional apertures therethrough for communicating the acoustic signal between the acoustic transducer and the exterior of the device, each of said apertures being no more than 10% of a size of the aperture disposed beneath the acoustic transducer.

14. A device, comprising:

a first wafer;

a second wafer;

a gasket bonding the first wafer to the second wafer to define a cavity between the first wafer and the second wafer;

an acoustic transducer disposed on the first wafer and disposed within the cavity between the first wafer and the second wafer, wherein the cavity includes an aperture for communicating an acoustic signal between the acoustic transducer and an exterior of the device; and a transducer circuit element comprising at least one of a transducer driver and a signal receiver, wherein the transducer circuit element is disposed on the second wafer.

15. The device claim 14, wherein the gasket includes the aperture.

16. The device of claim 15, wherein the gasket further includes a blocking portion disposed in a straight line between the aperture in the gasket and the acoustic transducer.

17. The device of claim 14, wherein one of the first and second wafers includes the aperture.

* * * * *